US007857733B2

(12) United States Patent
Tsakiris

(10) Patent No.: US 7,857,733 B2
(45) Date of Patent: Dec. 28, 2010

(54) CALF STRETCHER

(76) Inventor: Peter Tsakiris, 160 Jefferson Dr., Ocean Township, NJ (US) 07712

( * ) Notice: Subject to any disclaimer, the term of this patent is extended or adjusted under 35 U.S.C. 154(b) by 0 days.

(21) Appl. No.: 12/460,689

(22) Filed: Jul. 24, 2009

(65) Prior Publication Data

US 2010/0035733 A1 Feb. 11, 2010

Related U.S. Application Data

(60) Provisional application No. 61/188,067, filed on Aug. 6, 2008.

(51) Int. Cl.
*A63B 23/04* (2006.01)
*A63B 21/068* (2006.01)

(52) U.S. Cl. ..... 482/79; 482/52; 482/96; 482/907

(58) Field of Classification Search ..... 482/14, 482/23, 25, 34, 35, 51, 52, 74, 79, 96, 139, 482/142, 145, 148, 907; D25/62, 63; D21/670, D21/671, 686
See application file for complete search history.

(56) References Cited

U.S. PATENT DOCUMENTS 5,357,876 A * 10/1994 Kniefel et al. ..... 108/92
D362,477 S * 9/1995 Bluestein ..... D21/671
5,474,509 A * 12/1995 Hodgdon ..... 482/52
5,518,476 A * 5/1996 McLeon ..... 482/79
5,558,606 A * 9/1996 Poncini et al. ..... 482/79
5,718,656 A * 2/1998 Byrd et al. ..... 482/53
5,743,831 A * 4/1998 Jakich ..... 482/52
5,807,213 A * 9/1998 Poncini ..... 482/91
6,063,007 A * 5/2000 Sithole ..... 482/52
6,206,805 B1 * 3/2001 Helton et al. ..... 482/52
6,228,005 B1 * 5/2001 Gray ..... 482/23
6,425,843 B1 * 7/2002 Storfer et al. ..... 482/79
6,699,163 B2 * 3/2004 Gallagher ..... 482/142
7,169,098 B1 * 1/2007 McGanty ..... 482/146
7,666,128 B2 * 2/2010 Hubbard et al. ..... 482/148

(Continued)

FOREIGN PATENT DOCUMENTS

WO WO 9001355 A1 * 2/1990

*Primary Examiner*—Patricia M Bianco
*Assistant Examiner*—Victor K Hwang
(74) *Attorney, Agent, or Firm*—Clifford G. Frayne

(57) ABSTRACT

A device for stretching or flexing the calf muscles and tendons of the lower leg, the device in one embodiment having a base member formed with a 90 degree angle for positioning at the intersection of two walls and a floor, the base member having elevated non-skid planar surfaces emanating from the 90 degree angle to the edge of the base plate allowing a user to stand on the elevated non-skid surfaces with both feet and use one's body weight to stretch the calf muscles by lowering or raising ones heels below or above the plane of the elevated non-skid surface. In another embodiment, the device consists of a base member having a straight wall engaging edge with an upstanding wall, terminating in a flat planar surface and an angled ramp surface communicating between the flat upper surface and the base member, the calf stretcher allowing the user to stand on the base member and place selective right or left foot onto the ramp section for the respective stretching of the calf. Either embodiment may be used cooperatively with a wall or as a stand alone apparatus and may incorporate a stable hand rail.

3 Claims, 4 Drawing Sheets

U.S. PATENT DOCUMENTS

2003/0207738 A1* 11/2003 Wong ..... 482/74
2006/0078871 A1* 4/2006 Turner ..... 434/433
2006/0135332 A1* 6/2006 Larson ..... 482/148
2009/0111669 A1* 4/2009 Richter ..... 482/142

* cited by examiner

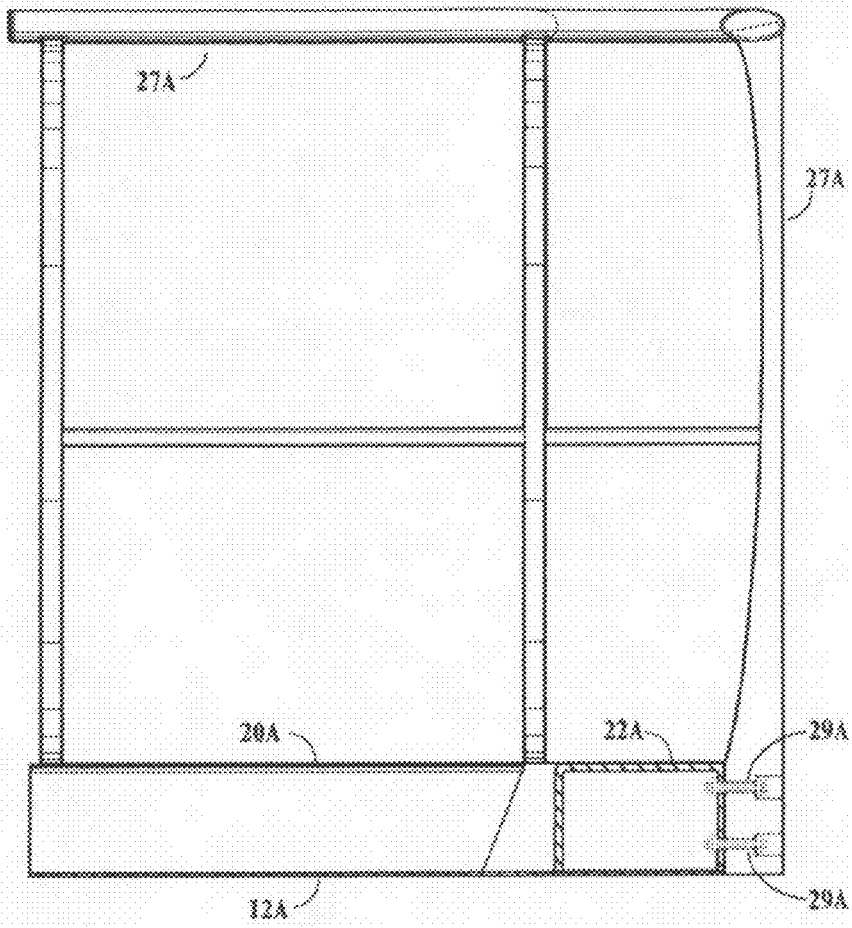
FIG. 7
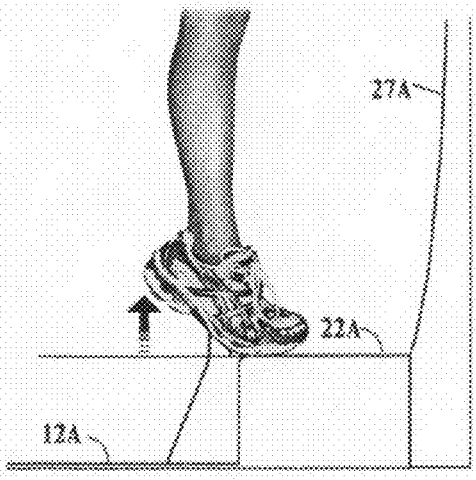
FIG. 8
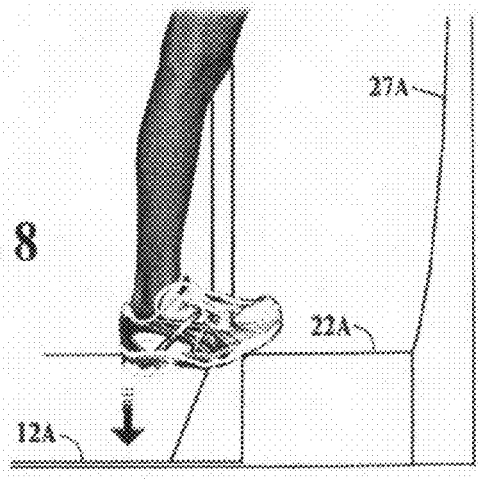

CALF STRETCHER

RELATED APPLICATIONS

Applicant claims the benefit of provisional application Ser. No. 61/188,067, filed Aug. 6, 2008.

BACKGROUND OF THE INVENTION

1. Field of the Invention

The present invention relates to exercise equipment, and more particularly, to a stretching device which allows for the user to stretch or flex their calf muscles and tendons of the lower legs.

2. Description of the Prior Art

Most exercise activities require some use of the legs in performing the activity. Running is almost totally a leg activity. However, weight lifters in the gym use their legs significantly when performing lifting exercises. Gymnasts utilize their legs in a significant number of the activities which they perform, as do martial arts practitioners. In any exercise activity it is desirous that the muscles be warmed up and stretched so to perform at optimal efficiency and to avoid possible injury or cramping. The calf muscles and lower leg tendons in particular need to be stretched and warmed because they are highly susceptible to cramping.

Gyms, athletic training facilities, and physical rehabilitation facilities have a variety of specialized apparatus which can be utilized to stretch the calf muscles. However, when one is not at a gym, athletic facility or a physical therapy facility, one must improvise in order to stretch the calf muscles. Most commonly one would lean against the wall and stretch the legs, which is not necessarily the most orthopedically correct manner of stretching the calf muscles. Runners often times position their feet against a street curb in order to achieve an appropriate angle to stretch the calf muscle.

Applicant's apparatus can be used anywhere, including in a room at home or in a gym, or training facility. Home use is particularly appropriate since more and more individuals are working out at home. Applicant's apparatus for stretching the calves is stand alone and also cooperative with the intersection of a floor and a wall, and the intersection two walls allowing the use of what might otherwise be dead space in a home or gym. Further, the apparatus does not occupy any significant space, making storage convenient. Still further, its design allows for the individual to properly position the leg, ankle and foot for proper angular stretching and flexing of the calf muscle.

OBJECTS OF THE INVENTION

An object of the present invention is to provide for a novel calf stretcher which orthopedically positions the user's leg, calf, ankle and foot in the proper position for properly stretching and flexing of the calf muscle and tendons of the lower leg.

Another object of the present invention is to provide for a novel calf stretcher which is cooperable with the corner of a room, the intersection of a floor and wall, which allows the user to properly stretch or flex the calf muscles.

SUMMARY OF THE INVENTION

A device for stretching or flexing the calf muscles and tendons of the lower leg, the device in one embodiment having a base member formed with a 90 degree angle for positioning at the intersection of two walls and a floor, the base member having elevated non-skid planar surfaces emanating from the 90 degree angle to the edge of the base plate allowing a user to stand on the elevated non-skid surfaces with both feet and use one's body weight to stretch or flex the calf muscles by lowering or raising ones heels below or above the plane of the elevated non-skid surface. In another embodiment, the device consists of a base member having a straight wall engaging edge with an upstanding wall, terminating in a flat planar surface and an angled ramp surface communicating between the flat upper surface and the base member, the calf stretcher allowing the user to stand on the base member and place selective right or left foot onto the ramp section for the respective stretching of the calf. Either embodiment may be used cooperatively with a wall or as a stand alone apparatus and may incorporate a stable hand rail.

BRIEF DESCRIPTION OF THE DRAWINGS

These and other objects of the present invention will become apparent, particularly when taken in light of the following illustrations wherein:

FIG. 7 is a side partial cutaway view of FIG. 6 illustrating one means of securing the hand rail; and FIG. 8 illustrates the manner of exercise utilizing the calf stretcher of FIG. 1, 4, 5, or 6.

DETAILED DESCRIPTION OF THE INVENTION

Figure 1:
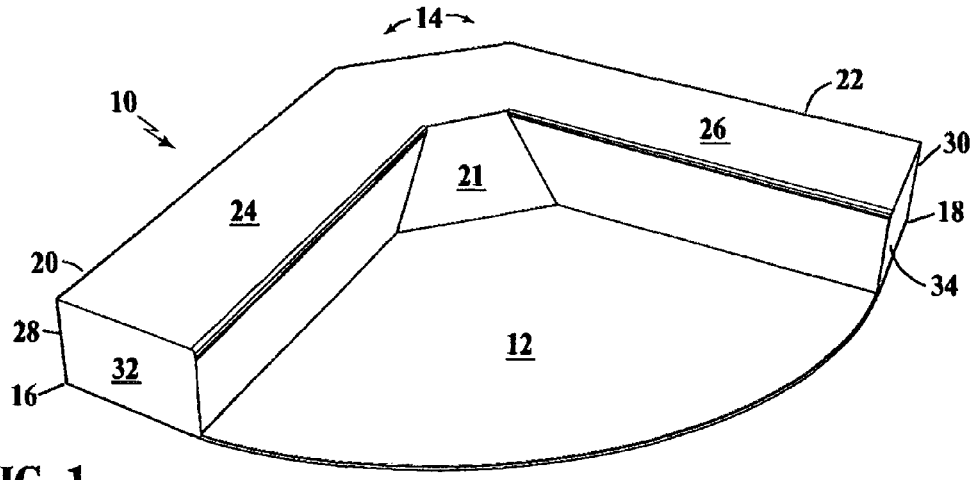
FIG. 1 is a perspective view of a corner wall calf stretcher.
Figure 3:
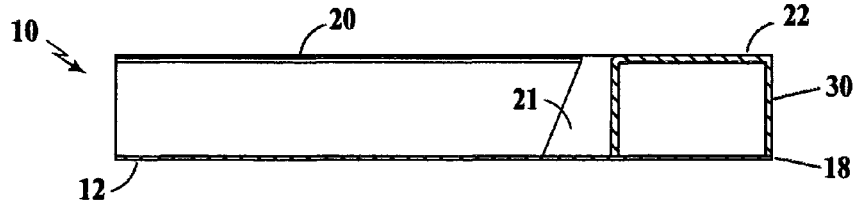
FIG. 3 is a side view of a corner unit calf stretcher.
Figure 2:
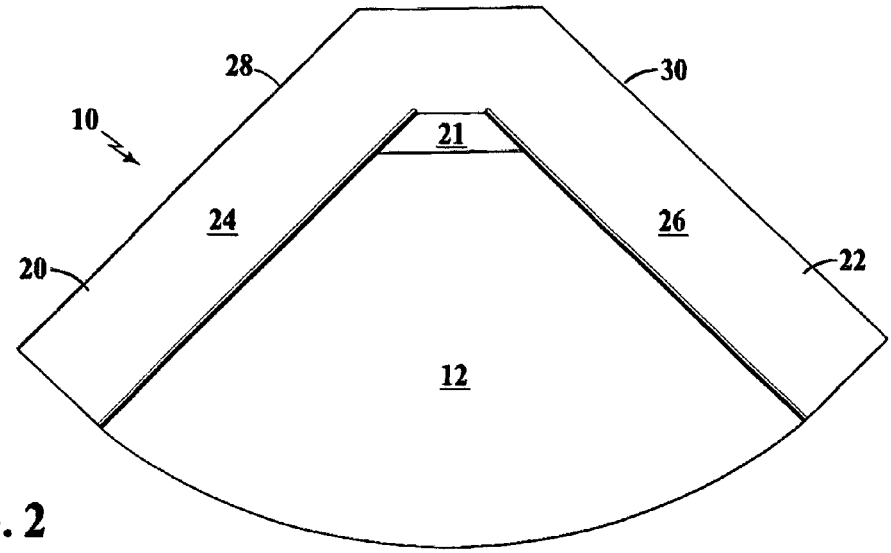
FIG. 2 is a top view of a corner unit calf stretcher.

FIG. 1 is a perspective view of a corner unit calf stretcher 10, FIG. 2 is a top view of the corner unit calf stretcher 10 of FIG. 1, and FIG. 3 is a side view. Corner unit calf stretcher 10 is formed with a base member 12, base member 12 having formed thereon, at least one planar 90 degree angle 14 defined by two 90 degree edges 16 and 18. Emanating from corner angle 14, are two upstanding curbs 20 and 22 having non-skid surfaces on their upper planar surfaces 24 and 26. The side walls 28 and 30 of upstanding curbs 20 and 22 along with the edges 16 and 18 of base member 12 in one embodiment, engage the intersection of two abutting walls and the floor upon which the base member is supported. In this configuration, the individual may stand on base member 12 and place the toe portion of the selective right foot, left foot, or both onto the upstanding curbs 20 and 22 in order to achieve the desired angle of the foot in order to lower the heel portion of the foot lower than the planar surfaces 24 and 26 to stretch the calf muscles while the individual may lean or touch the walls for support (See FIG. 6). The calf muscles may be stretched or flexed independently or simultaneously. The upstanding curbs 20 and 22 may be formed with end caps 32 and 34 and their respective termini. Still further, an angled ramp portion 21 may be formed at the intersection of curbs 20 and 22 to provide the user with a foot engaging surface in order to apply a different stretch or flex to the calf or leg muscle.

It will be recognized by those of ordinary skill in the art that the dimensions of the calf stretching unit 10 may vary, however, for ease of use not only in a gym or training facility locale, but also in a home locale, Applicant has found that a length of 36 inches on the upstanding curb edges and a height of 8 inches on the upstanding non-skid curb members, and a width of 10 inches of the non-skid upstanding curb members is sufficient to allow a user to properly engage the upstanding non-skid curb members and to obtain an adequate calf stretch in order to warm, strengthen and lengthen the muscles. The upstanding non-skid curb members 20 and 22 could be affixed to the base member 12 by any suitable means. As illustrated in FIG. 1, the base member incorporates a 90 degree angle with two wall engaging edges. The base member in FIG. 1 resembles a quarter circle, however, the base member may be formed in a different geometric shape without departing from the spirit and scope of the invention, and may have the curbs angled greater than 90° or slightly less than 90°, particularly with the free standing embodiment.

Figure 4:
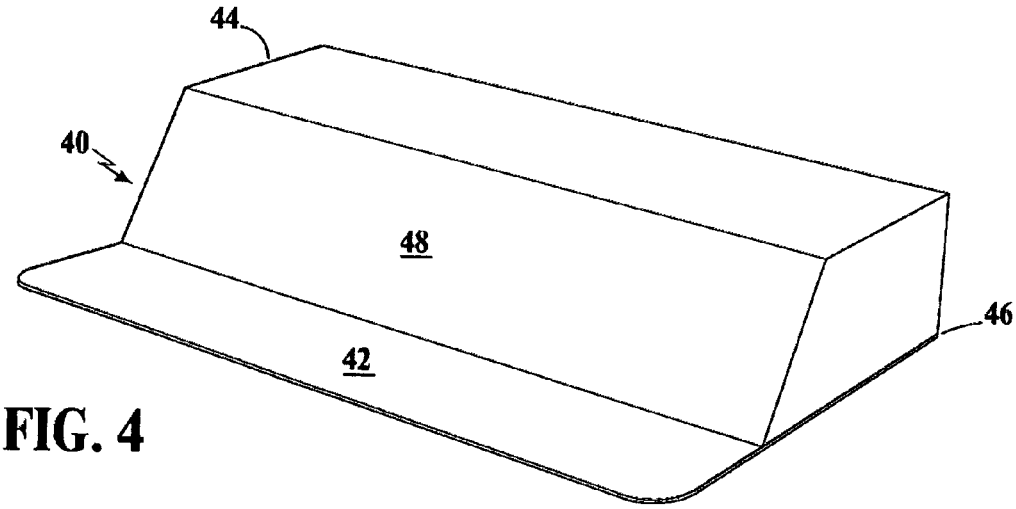
FIG. 4 is a perspective view of a straight wall unit calf stretcher.
Figure 5:
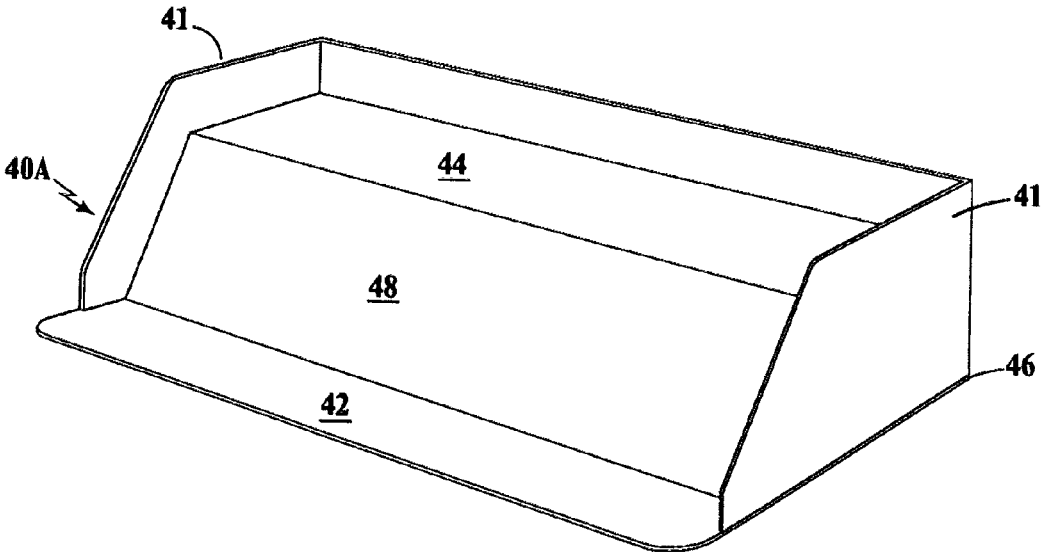
FIG. 5 is a perspective view of a second embodiment of a straight wall calf stretcher.

FIG. 4 is a perspective view of a straight wall unit calf stretcher 40 and FIG. 5 is a perspective view of a second embodiment of straight wall unit calf stretcher 40 of FIG. 4. The calf stretcher unit 40 and 40A of FIGS. 4 and 5 is formed with a base member 42, having a generally rectangular shape, there being a flat planar curb or a step portion 44 formed along the rear edge 46 of base member 42, said flat planar curb section 44 extending from the rear edge of the base member to a point where it angles downwardly in a ramp portion 48 terminating with base member 42. In this configuration, the user can stand on that portion of exposed base member 42 and place the foot onto the ramp portion 48 and utilize the wall which abuts and is juxtaposed the rear edge and rear surface 46 of the calf stretcher to stretch the user's calf. Alternatively the user may stand on surface 44 with toes of one or both feet and lower or raise heel above or below horizontal plane to stretch or flex the calf and tendons of lower leg. The user may selectively stretch one leg after the other with respect to the calf stretcher 40 and 40A as illustrated in FIGS. 4 and 5 or depending upon the dexterity of the individual, may be able to stretch both calf muscles simultaneously using the abutting adjacent wall for support. The difference between straight wall calf stretcher 40 and 40A are the end plates 41 on calf stretcher 40A to prevent rear and side slippage.

While it will be recognized by those of ordinary skill in the art that the dimensions of the straight wall unit calf stretcher 40 and 40A as illustrated in FIGS. 4 and 5 may vary, Applicant has found that a width of 24 inches with respect to base member 42 is adequate. The upstanding curb section would have a height of 8 inches and a width of 10 inches and the curb member would have a ramp length sufficient to form a comfortable angle between the base member 42 and the upper surface of upstanding planar curb section 44.

Figure 6:
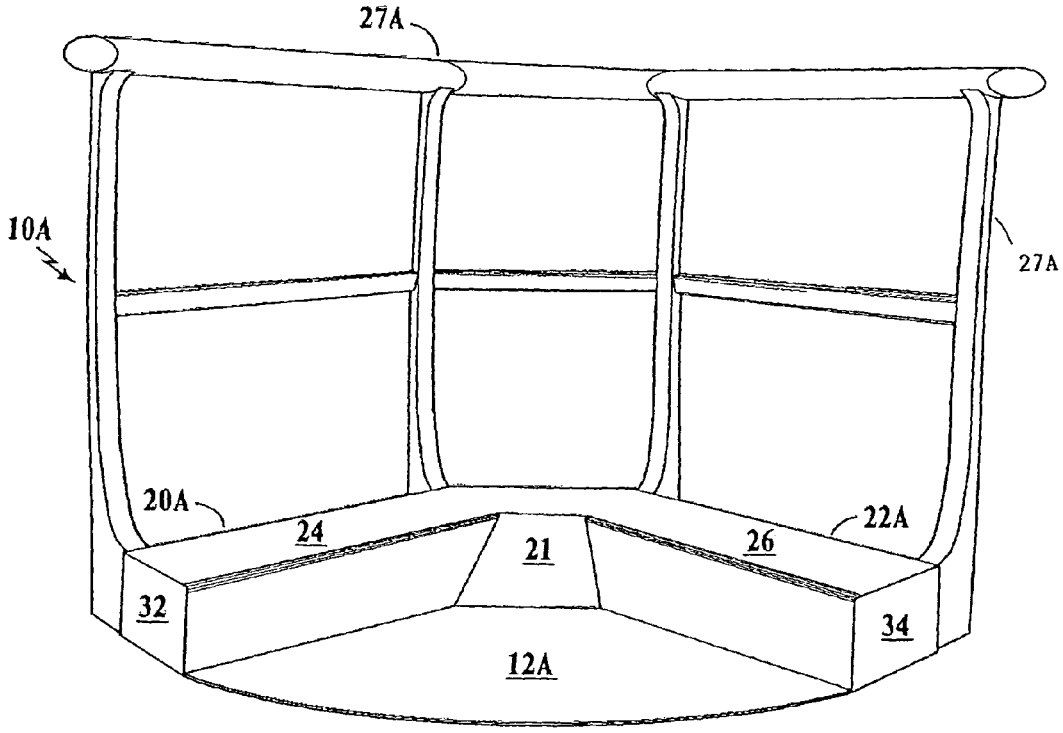
FIG. 6 is a perspective view of a corner wall unit as a free standing piece of equipment with incorporated hand rail.

FIG. 6 is a perspective view of the calf stretcher of FIGS. 1, 2, and 3 illustrating it as a free standing calf stretcher, as opposed to one cooperative with the corner of a room. In this configuration the base and curb members of the calf stretcher 10A are identical to that of those illustrated in FIG. 1. The calf stretcher 10A as illustrated in FIG. 6 includes an upstanding 90 degree hand rail 27A which is secured to the base member 12A and upstanding curbs 20A and 22A. The individual's use of the calf stretcher illustrated in FIG. 5 is identical to that of the calf stretcher illustrated in FIGS. 1 and 2 with the exception that the individual would now grasp the hand rail support while performing the exercise, and the device itself could be located in the middle of a room or other suitable location, and not be tied to its use at a corner of a room.

FIG. 7 is a side, partial cutaway view of the calf stretcher 10A illustrating one manner of securing the hand rail 27A to the curbs 20A and 22A and base member 12A utilizing a plurality of recessed threaded fasteners 29A.

FIG. 8 is a side view of the calf stretcher illustrating the positioning of an exerciser's foot on the curb portion 20A with the toes of the individual's foot positioned on upper planar surface 24 with the heels hanging outwardly, and the arrows respectively indicating the downward and upward movement of the heel below and above the planar surface 24 in order to effectuate the stretching or flexing of the calf.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. A calf stretcher for stretching the calf muscles and the tendons of an individual's calf and leg, the calf stretcher comprising:

a base plate having an upper and lower surface, the base plate defined by a plurality of peripheral edges at least two peripheral edges being straight and convergent with each other;

a vertical rear wall perpendicular to said base plate, the vertical rear wall defined by an upper edge;

an intermediate wall extending upwardly from said base plate and having an upper edge;

said vertical rear wall extends along two straight and convergent edges and said vertical intermediate wall extends upwardly from said base plate in parallel relationship to vertical rear walls, said upper edges of said vertical rear walls and said upper edges of said intermediate walls secured by an upper horizontal support surface defining two intersecting curbs for support of the ball of a foot of the user, said two intersecting curbs are separated at their intersection by an angled sloped surface for performance of additional calf stretching exercises;

said upper horizontal support surface having a non-skid surface for support of a ball of a foot of said individual's leg to stretch said calf muscles and tendons.

2. The calf stretcher in accordance with claim 1, wherein said calf stretcher includes vertical end plates perpendicular to said vertical rear wall, intermediate wall and base plate, said vertical end plates extending above said upper support surface and beyond said intermediate wall to prevent sidewise slippage of said ball of said foot from said upper support surface.

3. The calf stretcher in accordance with claim 1, wherein said vertical rear wall of said two intersecting curbs is formed with a vertically upstanding rail system for support of the hands or feet of the user to provide for additional stretching exercises and to provide stability when the said calf stretcher is used in a free standing orientation without abutting adjacent perpendicular room walls.

* * * * *